US006004052A

United States Patent [19]

Muranaka

[11] Patent Number: 6,004,052

[45] Date of Patent: Dec. 21, 1999

[54] PRINTING DEVICE WITH A HEATER PROVIDED AT A CHARGE APPLYING STATION

[75] Inventor: Masakazu Muranaka, Tokyo, Japan

[73] Assignee: Ricoh Company, Ltd., Tokyo, Japan

[21] Appl. No.: 09/006,976

[22] Filed: Jan. 14, 1998

[30] Foreign Application Priority Data

Jan. 14, 1997 [JP] Japan ..... 9-004245

[51] Int. Cl.[6] ..... B41J 13/03; B41J 13/076

[52] U.S. Cl. ..... 400/636; 347/105; 347/187

[58] Field of Search ..... 400/636, 120.08, 400/120.18, 617; 347/101, 105, 155, 165, 187, 212

[56] References Cited

U.S. PATENT DOCUMENTS

| | | | |
|---|---|---|---|
| 4,994,861 | 2/1991 | Brandon et al. | 271/208 |
| 5,021,804 | 6/1991 | Nozawa et al. | 400/120 |
| 5,326,179 | 7/1994 | Fukai et al. | 400/521 |
| 5,444,468 | 8/1995 | Fukushima et al. | 347/14 |
| 5,495,275 | 2/1996 | Martinengo | 347/112 |
| 5,708,930 | 1/1998 | Nagase et al. | 399/159 |
| 5,708,938 | 1/1998 | Takeuchi et al. | 399/250 |
| 5,742,318 | 4/1998 | Miyauchi et al. | 400/618 |
| 5,781,218 | 7/1998 | Wakahara et al. | 347/141 |

FOREIGN PATENT DOCUMENTS

| | | |
|---|---|---|
| 3-15582 | 1/1991 | Japan . |
| 5-286130 | 11/1993 | Japan . |
| 717088 | 1/1995 | Japan . |
| 7266570 | 10/1995 | Japan . |
| 8-34127 | 2/1996 | Japan . |
| 9-197877 | 7/1997 | Japan . |

*Primary Examiner*—Ren Yan
*Assistant Examiner*—Daniel J. Colilla
*Attorney, Agent, or Firm*—Cooper & Dunham LLP

[57] ABSTRACT

A printing apparatus for printing an image on a sheet fed along a sheet feeding path. The printing apparatus includes a print head unit and a sheet feeding system. The sheet feeding system may include a pair of rollers and a sheet guide device. The pair of rollers apply a charge to a sheet and feed the sheet toward a printing device. The sheet guide device is positioned adjacent the printing device and attracts the charged sheet and guides the sheet fed by the pair of rollers. The sheet feeding system may also include a charge dissipating device that removes the charge on the sheet after printing.

39 Claims, 5 Drawing Sheets

PRINTING DEVICE WITH A HEATER PROVIDED AT A CHARGE APPLYING STATION

BACKGROUND

1. Field of the Invention

The present application relates in general to a printing apparatus. More particularly, the present application relates to sheet feeding systems for the printing apparatus.

2. Description of the Related Art

In conventional ink jet printing apparatus ink jet printing is generally performed by discharging ink from a plurality of nozzles of an ink jet printing head onto a recording medium or sheet as the sheet is fed past the printing head. However, as the sheet is being fed toward the printing head the leading and trailing edges of the sheet have a tendency to curve or float so that the quality of the image being formed at the edges is lower than the quality of the image formed on the rest of the sheet. Further, in such conventional ink jet printing apparatus, when ink drops discharged onto the sheet penetrate into the fibers of the sheet, the fibers become moist and expand so that the sheet may partially wrinkle, curve and/or float causing the sheet to contact the printing head. If the sheet contacts the printing head the quality of the image being printed may be affected.

One technique conventional ink jet printing apparatus used to avoid the problems caused when the sheet wrinkles, curves or floats was to reduce the area of the sheet that could be printed on so no printing occurred close to the edges.

Another technique for avoiding these problems is discussed in Japanese Laid Open patent Application Number 07-17088. In the '088 publication the sheet is grasped by a feeding roller and a pinch roller in contact with the feeding roller and an ejecting roller, and by a spur in contact with the ejecting roller. However, in this technique a trailing edge of the sheet curves upward or floats after the trailing edge passes a gap between the feeding roller and the pinch roller so that suitable printing of an image on the trailing edge of the sheet cannot be achieved.

Another technique for avoiding these problems is discussed in Japanese Laid Open patent Application No. 17-266570. In the '570 publication a sheet is pre-heated and then is fed by a feeding belt having a plurality of holes therethrough from which air is suctioned by a suction member disposed below the feeding belt to reduce edge floating. However, with this technique smaller sized sheets cannot be used because some of the air suctioned by the air suction member passes through holes in the feeding belt that are not covered by the smaller sized sheet. As a result, the suction force on the sheet is insufficient to smoothly feed the sheet by such a sheet feeding device.

SUMMARY

The present application provides a printing apparatus for printing an image on a sheet fed along a sheet feeding path. In one embodiment, the printing apparatus includes a printing device for printing at a printing station an image on a sheet fed along a sheet feeding path, a pair of rollers each having an outer layer of elastic material having a predetermined unit resistivity ranging from between about $1\times10^{10}$ Ω·cm and about $1\times10^{20}$ Ω·cm, and a sheet guide device positioned adjacent the printing station that guides the sheet through the printing station while creating an attraction force with the charged sheet to attract the sheet to the guide device.

Preferably, the elastic material of at least one of the pair of rollers is made of silicon rubber, and the outer layers of the rollers are in pressure contact to create a feeding force for feeding the sheet along the sheet feeding path toward the printing station, and for creating a static charge on the sheet as the sheet passes between the rollers.

The guide device in one embodiment may be a plate, preferably made of a polyester resin, and in an alternative embodiment the guide device may be a transfer belt system positioned adjacent the printing device. Such a transfer belt system may include a polyester resin belt and a plurality of belt rollers that apply tension to the belt and that rotate the belt.

The printing apparatus according to the present application also includes a pair of transfer rollers positioned along the sheet feeding path after the printing station. The transfer rollers receive printed sheets from the guide device and further feed the sheet along the sheet feeding path. A charge dissipating device may be positioned along the sheet feeding path after the printing station to remove the charge carried on the sheet after printing. The charge dissipating device may be a grounded brush that contacts the sheet. Other known techniques for dissipating charge from the sheet are also contemplated.

Further, a sheet heating system may be used to remove moisture from the sheet prior to charging. Removing the moisture from the sheet permits even distribution of the charge on the sheet. In one embodiment, the sheet heating system includes a heating element positioned in at least one of the pair of rollers, and a heat conducting layer positioned between the outer layer of the at least one of the pair of rollers and the heating element. In an alternative embodiment, the heating system may include a plate shaped heater that can be positioned adjacent the sheet feeding path prior to or after the pair of rollers.

The present application also provides a system for printing on a sheet. The system may be a facsimile machine, a printer or a copy machine that incorporates the printing apparatus according to the present application. For example, the printing system may include a processing unit, a data input unit coupled to the processing unit that receives data to be printed, a printing apparatus coupled to the processing unit that feeds charged sheets to a printing station, prints the data on the charged sheet and transfers the sheet for subsequent processing by a fixing unit coupled to the processor that fixes the data on the sheet after printing.

The present application also provides a method for feeding a sheet through a printing station where a printing device prints an image on the sheet. The method includes feeding the sheet through the printing station and applying a charge on the sheet, guiding the sheet on a guide through the printing station, printing on the sheet with the printing device as the sheet is guided through the printing station, and removing the sheet from the printing station. As the sheet is guided through the printing station, an attraction force between the charged sheet and the guide attracts the sheet to the guide to prevent the sheet from wrinkling, curving or floating while printing.

BRIEF DESCRIPTION OF THE DRAWINGS

Preferred embodiments of the application are described hereinbelow with reference to the drawings wherein.

DETAILED DESCRIPTION

The present application provides a sheet feeding system for printing apparatus, such as ink jet printing apparatus. A first embodiment of the present application is described with reference to FIGS. 1 and 2. As shown in the FIG. 1, the printing apparatus includes a print head unit 4 and a sheet feeding system 10. The print head unit 4 has a plurality of nozzles for selectively discharging ink drops onto a sheet 1 in response to printing signals from, for example a computer, and a plurality of corresponding pressure chambers for storing ink which is discharged by the corresponding nozzle. The print head unit 4 also includes a plurality of energy generating members, such as piezoelectric elements, used as an electrical/mechanical converter or a heat generating resistance used as an electrical/heat converter, wherein one energy generating member corresponds to one of the nozzles.

The print head unit 4 is mounted on a carriage (not shown) for moving the print head unit 4 in a main scanning direction which is perpendicular to a sheet feeding direction defined by arrow A. The area 4*a* of the print head unit adjacent the sheet defines a printing station and printing on a sheet at the printing station is executed by feeding a sheet 1 through the printing station and scanning the printing head 4 in the main scanning direction.

Figure 1:
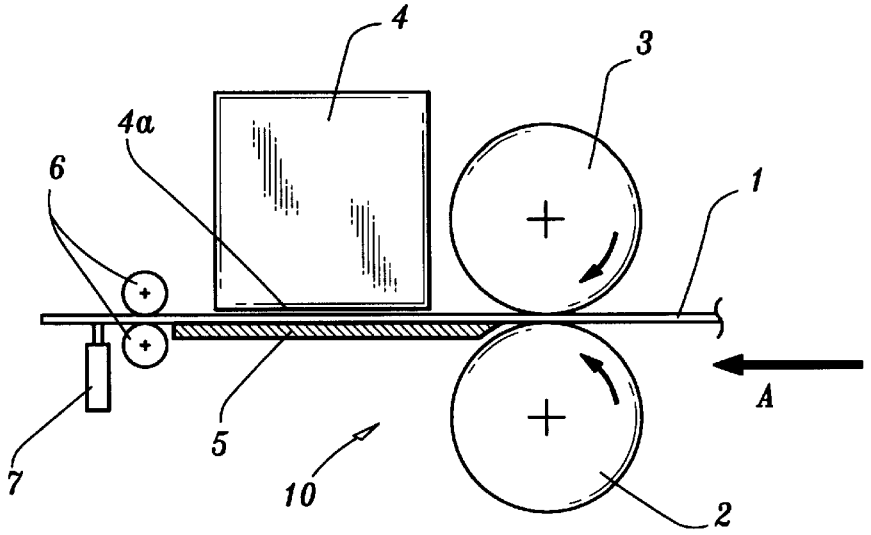
FIG. 1 is a schematic representation of a printing apparatus employing a first embodiment of the sheet feeding system according to the present application illustrating a sheet feeding system having a pair of rollers used to feed sheets past a printing head using a plate type sheet guiding device.

Continuing to refer to FIG. 1, the sheet feeding system is configured to feed a sheet along a sheet feeding path in the direction of arrow A toward, through and away from a printing station. The sheet feeding system includes platen roller 2, pressure roller 3, a sheet guide device 5, transfer rollers 6 and charge dissipating device 7. The platen roller 2 and the pressure roller 3 are in pressure contact and are disposed upstream of the printing station relative to the sheet feeding direction to feed the sheet 1 toward the printing station. The pressure roller 3 is biased by a biasing member (not shown) against the platen roller 2 so that the two rollers 2 and 3 are in pressure contact. The point where the outer surface of the platen roller 2 contacts the outer surface of the pressure roller 3 creates a nip therebetween. To pass the sheet between the rollers, the platen roller 2 is, for example, rotated clockwise by a driving motor (not shown) and the pressure roller 3 is rotated counter-clockwise by the platen roller 2 to feed the sheet 1 toward the printing station.

Figure 2:
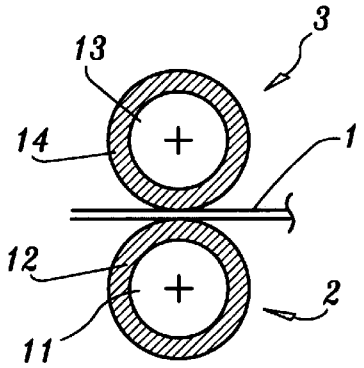
FIG. 2 is a view of the pair of rollers of FIG. 1 in partial cross-section, illustrating an outer layer of elastic material on each roller.

Referring to FIG. 2, the platen roller 2 is composed of a cylindrical core 11 which is made of, for example, SUS or an aluminum alloy, and an outer layer 12 made of an elastic material. The pressure roller 3 is also composed of a cylindrical core 13 which is made of, for example, SUS or an aluminum alloy, and an outer layer 14 made of an elastic material. Preferably, the outer layers 12 and 14 are made of silicon rubber which is formed around the corresponding core 11 or 13.

The elastic material used to form each outer layer 12 and 14 has sufficient sheet gripping and friction generating properties so that the rollers function as a sheet feeding device and a charge generating device. Preferably, the elastic material has volume unit resistivity ranging from between about $1\times10^{10}$ and about $1\times10^{20}$ Ω·cm.

For example, if the platen roller 2 and the pressure roller 3 each have a volume unit resistivity ranging between about $1\times10^{14}$ Ω·cm and about $1\times10^{16}$ Ω·cm a static charge of about 1 kv may exist on the sheet 1. This static charge can be created on the sheet because both surfaces of the sheet 1 passing through the nip portion of the rollers 2 and 3 are rubbed by portions of the rollers 2 and 3 so that the friction between the rollers and the sheet create the static charge. That is, the elastic material forming each outer layer 12 and 14 deforms at the nip portion and is then restored to its original form after the nip portion. This deformation and restoration process causes the rollers and sheet to rub together and creates the static (or friction) charge on the surfaces of the sheet. Preferably, the elastic material forming each outer layer 12 and 14 of rollers 2 and 3 is different so that a static charge having a predetermined value (e.g., 1 kv) is created.

Referring again to FIG. 1, the sheet guide device 5 is positioned adjacent to the printing station and below the printing head unit 4 as seen in FIG. 1 and is preferably made of a resin material. The sheet guide device receives sheets from the rollers 2 and 3 and guides the sheets along the sheet feeding path through the printing station.

Figure 9:
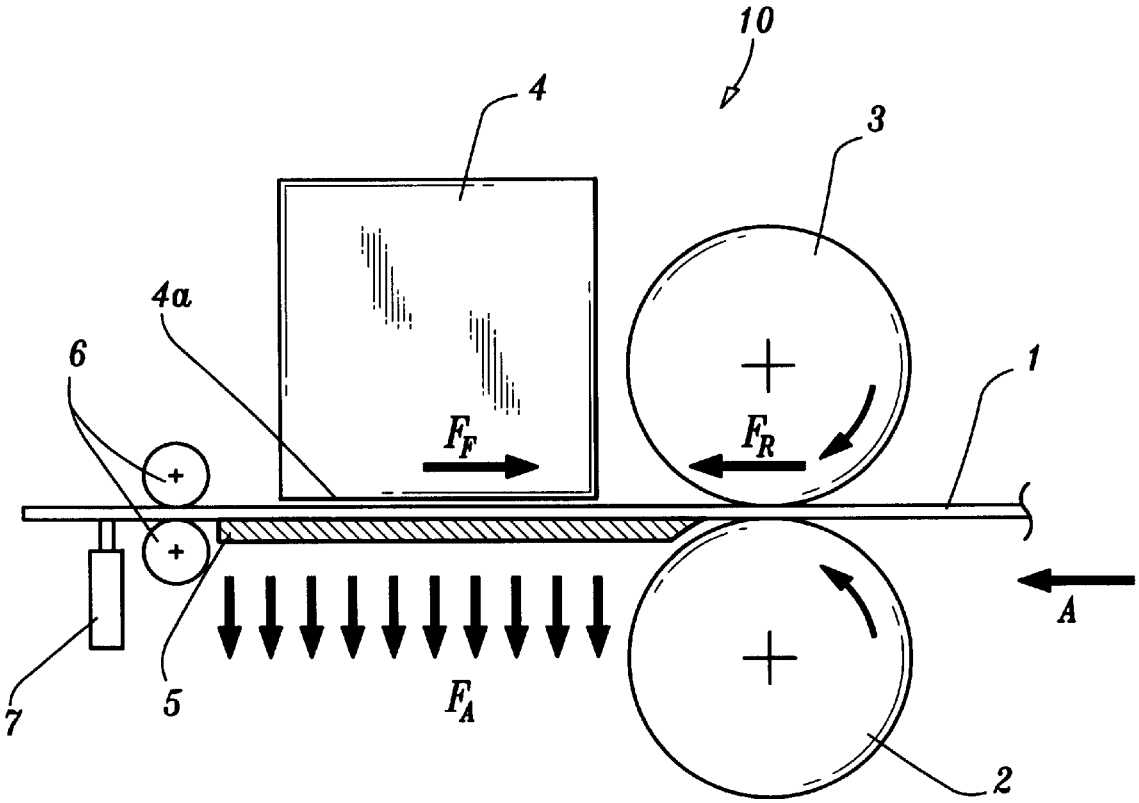
FIG. 9 is a schematic representation of the printing apparatus of FIG. 1 illustrating the forces exerted on the sheet.

FIG. 9 illustrates the forces acting on the sheet as it is fed by the rollers 2 and 3. The feeding force $F_R$ is the force exerted by the rollers on the sheet to feed the sheet toward the printing station. The attraction force $F_A$ attracts the sheet 1 toward the guide plate 5 to prevent the sheet from wrinkling, curving and/or floating as it moves through the printing station. Contact between the guide plate 5 and the sheet creates a friction force $F_F$ which opposes the feeding force. In addition, in order for the sheet to move through the printing station at a constant speed, the force for feeding the sheet $F_R$ should be greater than the friction force $F_F$. The friction force is a function of the contact area between the sheet and the guide plate. Another force acting on the sheet is known as an anti-bending force $F_{AB}$ (not shown) which is the force which can be exerted on the sheet before the sheet bends when the sheet is being fed in a flat state. The anti-bending force should be greater than the difference between the feeding force $F_R$ and the friction force $F_F$ in order to avoid bending of the sheet when fed through the guide plate.

The transfer rollers 6 are positioned at a point on the sheet feeding path a predetermined distance from the rollers 2 and 3 and downstream of the sheet guide device 5 relative to the sheet feeding direction. The transfer rollers 6 receive sheets from the sheet guide device 5 and further transfer the sheets along the sheet feeding path. A charge removing member (not shown) is disposed beside one of the transfer rollers 6 to remove any charge on the surface of the transfer rollers 6.

The charge dissipating device 7 is preferably a brush positioned adjacent the sheet feeding path and downstream of the transfer rollers 6. The brush is grounded to dissipate charge carried on the sheet 1 when the brush 7 contacts the sheet 1 as it is transferred along the sheet feeding path by the transfer rollers 6.

The operation of the first embodiment of the sheet feeding system for the printing apparatus will now be explained. Initially, a sheet 1 is fed from a sheet cassette (not shown) toward the rollers 2 and 3 which move the sheet along the sheet feeding path toward the printing station. Since the sheet 1 is rubbed by each outer layer 12 and 14 of the platen roller 2 and the pressure roller 3, the surfaces of the sheet 1 are charged with a static charge having a predetermined value (e.g., 1 kv). As the sheet moves along the sheet feeding path, an attraction force between the charged sheet and the sheet guide plate 5 attracts the sheet 1 toward the guide plate 5 to prevent the sheet from wrinkling, curving, floating or like anomalies, especially at the leading and trailing edges.

As the sheet is fed through the printing station, printing of an image on the sheet is synchronized with the movement of the sheet, and the attraction force flattens the sheet for high quality printing on the sheet particularly at the leading and trailing edges.

After the sheet passes through the printing station, the transfer rollers 6 receive the sheet to further feed the sheet along the sheet feeding path. As the sheet continues to move along the path, the sheet contacts the brush 7 to remove the static charge on the sheet. With the charge removed from the sheet 1, the sheet can be ejected from the printing apparatus without jamming.

By charging the sheet and using the attraction force between the sheet and the guide plate, floating of the sheet, especially at the leading and trailing edges, is substantially reduced at least until printing operation is completed. Accordingly, printing on the sheet can be close to the leading and trailing edges of the sheet 1.

Figure 3:
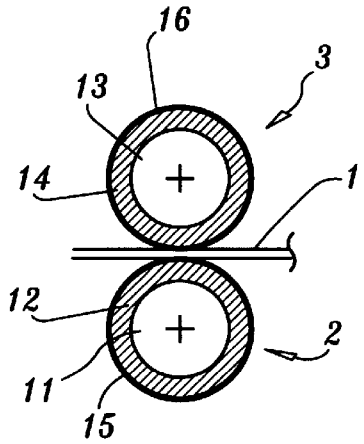
FIG. 3 is an alternative embodiment for the pair of rollers of FIG. 1 in partial cross-section, illustrating each roller having a surface layer formed of a fluorine resin material on the outer layer.

Referring now to FIG. 3, an alternative embodiment for the construction of the platen roller 2 and the pressure roller 3 will be described. In this embodiment, surface layers 15 and 16 are disposed around the outer layers 12 and 14 of the rollers 2 and 3. The surface layers 15 and 16 are preferably formed of a material having a unit volume resistivity that is less than $1\times10^{18}$ Ω·cm so that the static charge created on the sheet 1 is slightly lower but within a range in which the attraction force attracts the sheet 1. Reducing the static charge permits the sheet to more efficiently peel off the rollers 2 and 3. Reducing the attraction force permits the sheet to more efficiently peel off the guide plate 5 when the sheet is delivered from the guide plate 5 to the transfer rollers 6.

A second embodiment of the sheet feeding system for the printing apparatus will be described with reference to FIG. 4. In this embodiment, a transfer belt system is employed to guide the sheet through the printing station and to transfer the sheet after passing through the printing station. The transfer belt system 20 includes a transfer belt 21, a drive roller 22, a tension roller 23 and a follower roller 25. In this embodiment, the platen roller 2, pressure roller 3, printing head unit 4 and brush 7 are similar to those described in the first embodiment. Therefore, detailed explanations for these devices are omitted.

Figure 4:
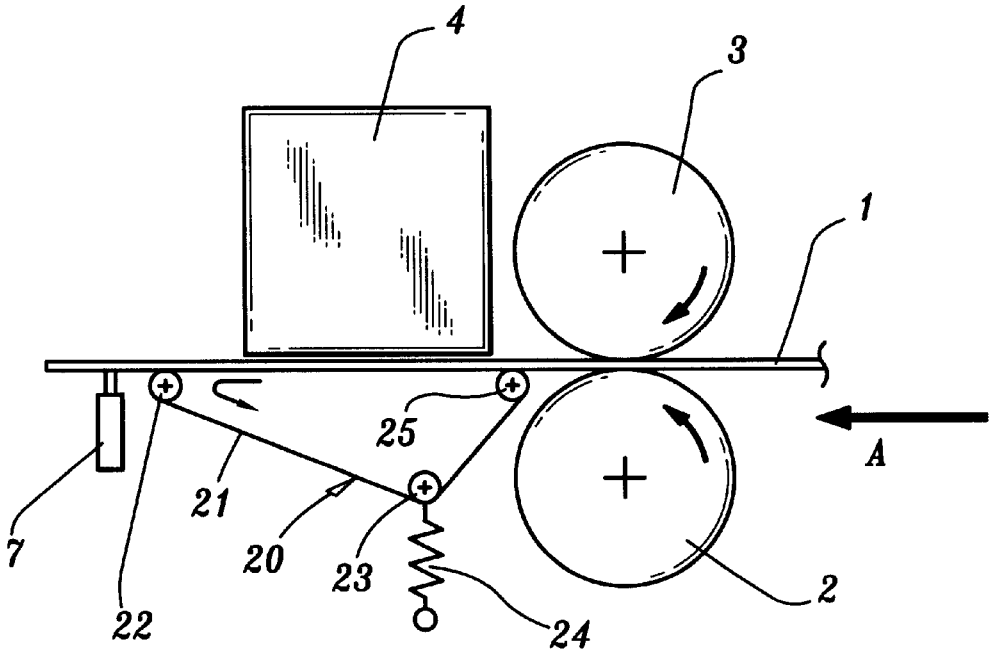
FIG. 4 is a schematic representation of the printing apparatus employing a second embodiment of the sheet feeding system according to the present application illustrating a sheet feeding system having a pair of rollers used to feed sheets past a printing head using a transfer belt type sheet guiding device.

As shown in FIG. 4, the transfer belt 21 is positioned below the printing head unit 4 between the rollers 2 and 3 and the brush 7. The transfer belt 21 is wound around the drive roller 22 which is driven by a motor (not shown), the tension roller 23 which is biased by a compressing spring 24 and the follower roller 25. To feed the sheet along the sheet feeding path in the sheet feed direction, the transfer belt 21 is rotated counter-clockwise. The speed at which the transfer belt is rotated is controlled by a controller (not shown) and is regulated to correspond to the speed of the periphery of the platen roller 2. Rotating the belt at this speed permits smooth transfer of the sheet from the rollers 2 and 3 to the transfer belt 21.

Preferably, the transfer belt 21 is a seamless belt made of a material with sufficient properties to create an attraction force between the charged sheet and the belt 21. One such material is polyester resin. However, other materials having similar properties are also contemplated.

The operation of the above described second embodiment is similar to the operation of the first embodiment. More particularly, a sheet 1 is charged by the rollers 2 and 3 and transferred to the rotating transfer belt 21. The attraction force between the charged sheet 1 and the belt 21 pulls the sheet toward the belt 21 so that the sheet is transferred through the printing station without wrinkling, curving and/or floating or like anomalies, particularly, at the leading and trailing edges. As the sheet is fed through the printing station, printing of an image on the sheet is synchronized with the movement of the sheet, and the attraction force flattens the sheet for high quality printing on the sheet particularly at the leading and trailing edges of the sheet.

After the sheet passes the printing station, sheet 1 separates from the transfer belt 21 and continues to travel along the sheet feeding path without jamming due to a small curvature of the drive roller 22. After the sheet is separated from the belt, the sheet contacts brush 7 which dissipates the charge on the sheet and continues along the sheet feeding path until ejected from the printing apparatus.

Figure 5:
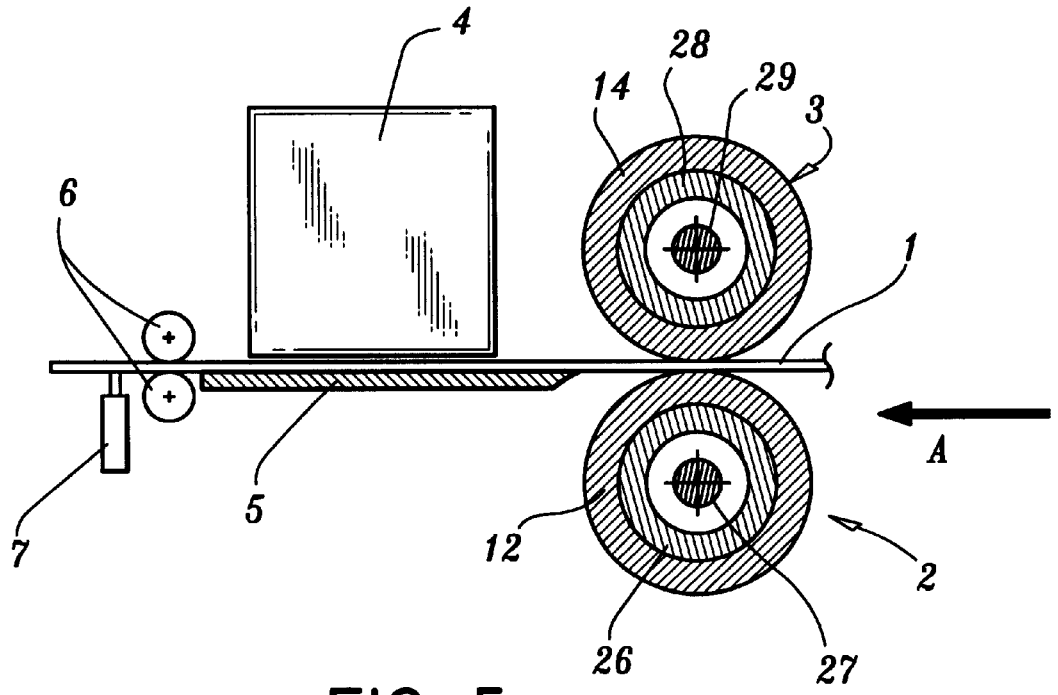
FIG. 5 is schematic representation of a printing apparatus employing a third embodiment of the sheet feeding system illustrating heating elements in each of a pair of rollers used to feed sheets.

A third embodiment of the present application will be described with reference to FIG. 5. This embodiment is similar to the embodiment of FIGS. 1 and 2 in that it includes ink printing unit 4, guide plate 5, transfer rollers 6 and brush 7 which function as described above. It is also contemplated that the transfer belt system 20 shown in FIG. 4 could be substituted for the guide plate 5 and the transfer rollers 6.

In this embodiment, a heating system is used to heat the sheet to remove moisture therefrom so that the static charge created on the sheet is uniformly distributed. In this embodiment, the heating system is incorporated into the platen and pressure rollers. More particularly, the platen roller 2 includes a heating element 27 as a core, a heat conducting layer 26 and outer layer 12. Similarly, the pressure roller 3 includes a heating element 29 as a core, a heat conducting layer 28 and outer layer 14. It should be noted that one or both of the rollers can be constructed with the heating element.

Preferably, the heat conducting layer 26 is a cylinder made of SUS, and the heating element 27 is a bar heater located in the cylinder 26. As with the above embodiments, the outer layer 12 is made of an elastic material, preferably silicon rubber, which is wrapped around a surface of the cylinder 26 by a baking method. Preferably, the heat conducting layer 28 is a cylinder made of SUS, and the heating element 29 is a bar heater located in the cylinder 28. The outer layer 14 is made of an elastic material, preferably silicon rubber, which is wrapped around a surface of the cylinder 28 by a baking method. The temperature of the heating elements 27 and 29 is controlled so that the temperature of the outer layers 12 and 14 are within a predetermined range sufficient to remove moisture from the sheet. Conventional temperature controllers (not shown) may be used to control the temperature of the heating elements.

As noted, the heating elements 27 and 29 are provided to remove moisture from the sheet so that the static charge created on the surfaces of the sheet is evenly distributed to improve the attraction force between entire sheet and the guide plate (or transfer belt). During a printing operation one or both heating elements may be energized to remove moisture from the sheet.

The operation of above described third embodiment will now be explained. Initially, electrical power is supplied to the heating elements 27 and 29 so that the outer layers 12 and 14 of the platen roller 2 and pressure roller 3 are heated to a predetermined temperature. A sheet 1 is then fed to the rollers 2 and 3 so that the sheet is heated and a static charge is created on the surfaces of the sheet. As the sheet moves along the sheet feeding path, an attraction force between the charged sheet and the guide plate pulls the sheet toward the guide plate to prevent the sheet from wrinkling, curving and/or floating as it moves through the printing station. As the sheet 1 is fed through the printing station, printing of an image on the sheet is synchronized with the movement of the sheet, and the attraction force flattens the sheet for high quality printing on the sheet, particularly close to the leading and trailing edges. After the sheet passes through the printing station, the sheet contacts the brush 7 to remove the static charge on the sheet. As with the above embodiment, with the charge removed the sheet can be ejected from the printing apparatus without jamming.

Figure 6:
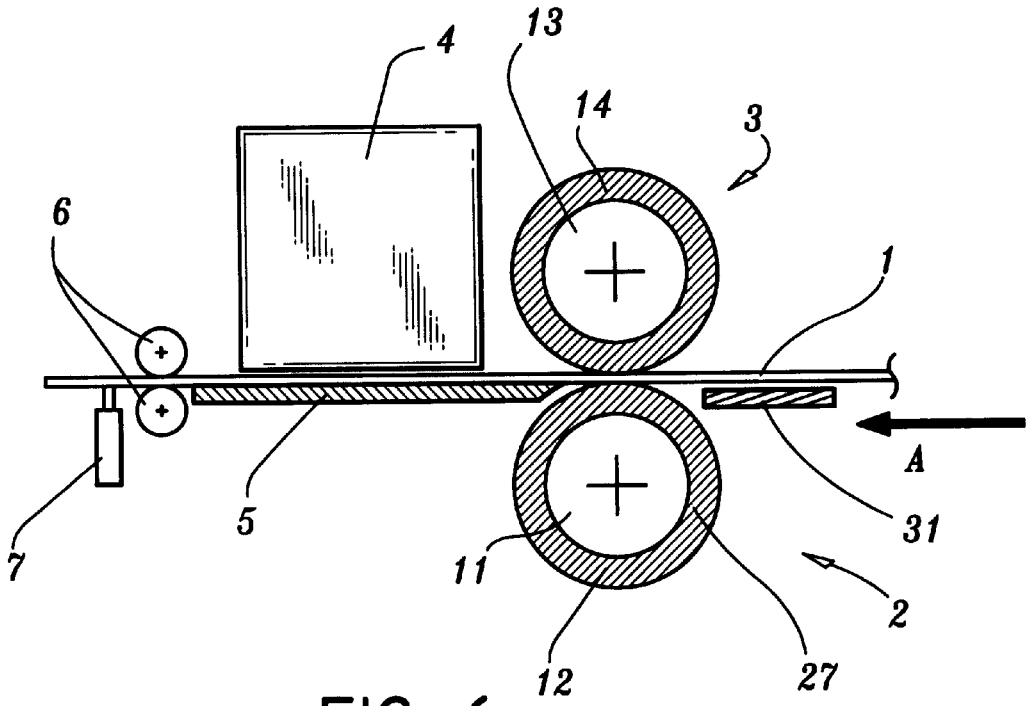
FIG. 6 is a schematic representation of a printing apparatus employing a fourth embodiment of the sheet feeding system illustrating a heating plate used to heat the sheet before passing through a pair of rollers.

A fourth embodiment of the present application will be described with reference to FIG. 6. This embodiment is similar to the embodiment of FIGS. 1 and 2 in that it includes platen roller 2, pressure roller 3, ink printing unit 4, guide plate 5, transfer rollers 6 and brush 7. Additionally, a heating system is used to heat the sheet and remove moisture from sheet. Removing the moisture from the sheet permits the charge created on the sheet to be evenly distributed. In this embodiment the heating system includes a plate heater 32 positioned adjacent the sheet feeding path prior to the rollers 2 and 3 so that the sheet 1 is heated before reaching the rollers. Thereafter, the printing apparatus operates in a similar manner as the embodiment of FIG. 1.

Figure 7:
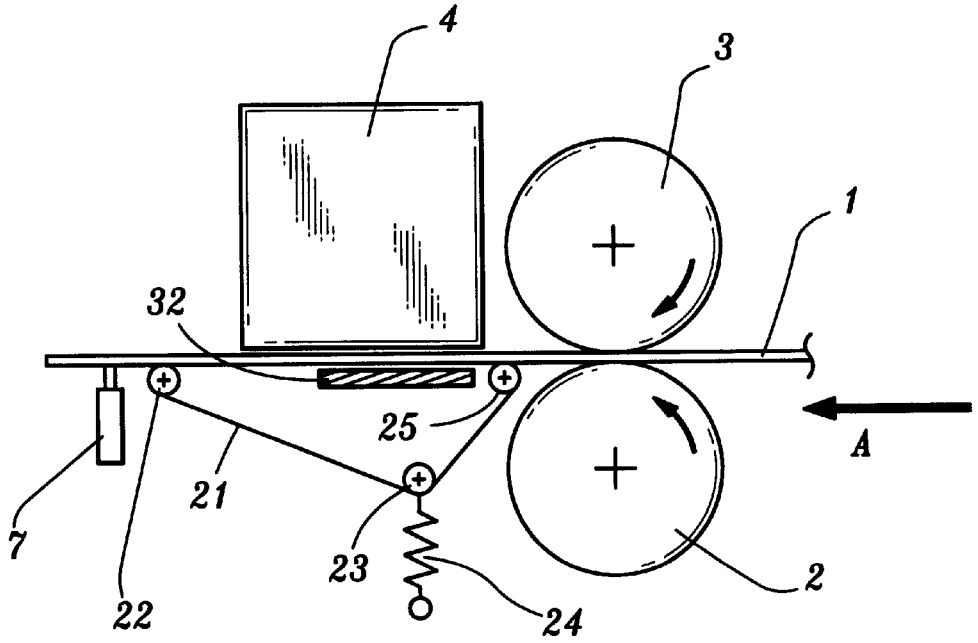
FIG. 7 is a schematic representation of a printing apparatus employing a fifth embodiment of the sheet feeding system illustrating a heating plate used to heat the sheet on the transfer belt type sheet guiding device.

A fifth embodiment of the sheet feeding system for the printing apparatus will be described with reference to FIG. 7. This embodiment is similar to the embodiment of FIG. 4 and includes a heating system. The heating system in this embodiment includes a heating plate 32 positioned adjacent the transfer belt 21 in the area of the printing station. The heating plate 31 heats the transfer belt 21 and thus the sheet to remove moisture from the sheet after it is charged.

Figure 8:
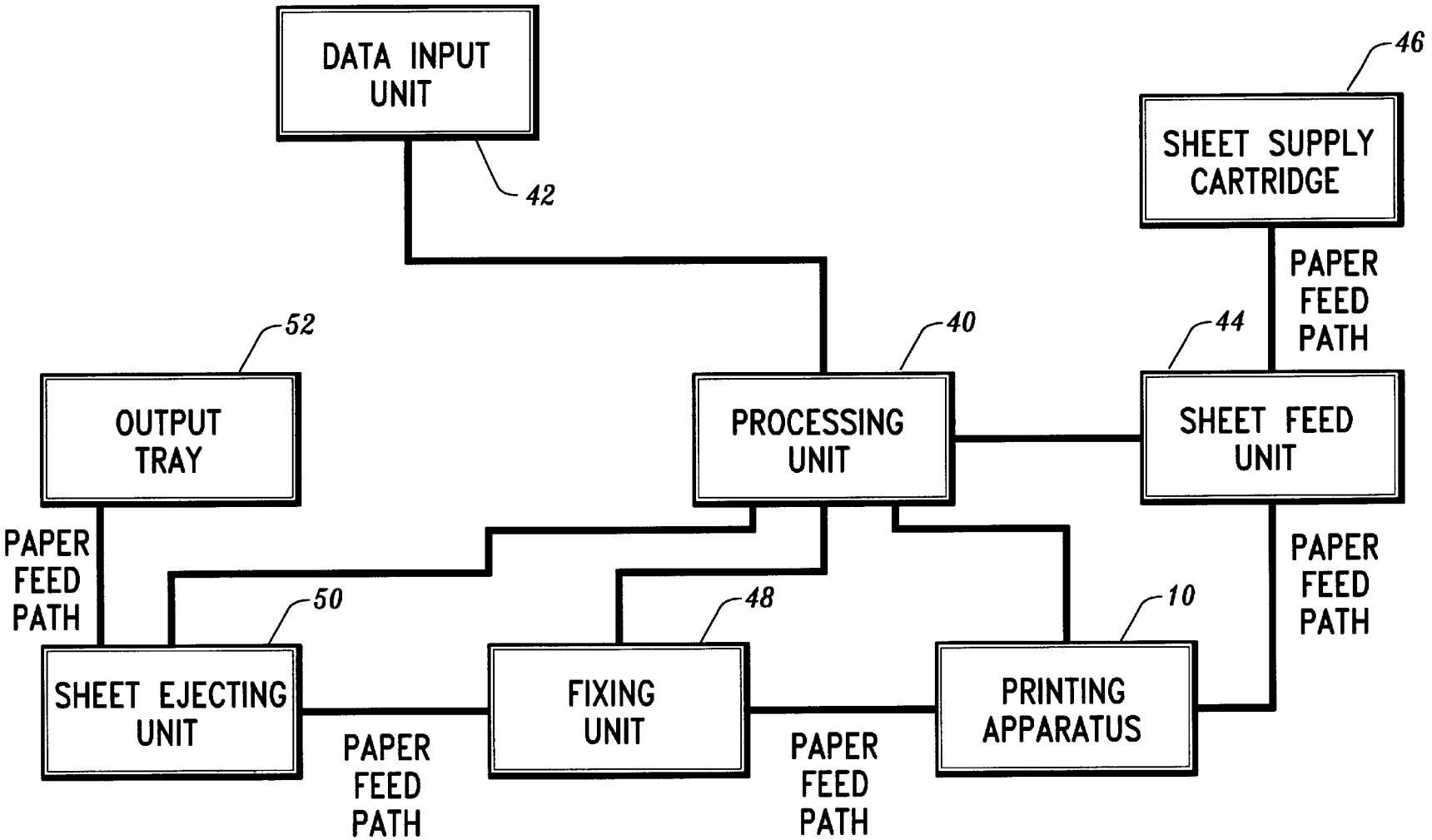
FIG. 8 is a block diagram of a printing system according to the present application.

The present application also provides a printing system, such as a facsimile machine, printer, or copier that includes the above-described printing apparatus. An example of such a printing system is provided in FIG. 8, which includes conventional engines for such printing systems. For example, the printing system engine includes a processing unit 40, a data input unit 42, such as data from a computer, telephone lines, an image reading unit, or a scanner, connected to the processing unit, a sheet feed unit 44 that retrieves sheets from sheet supply cartridges 46 and feeds the sheets for printing, a fixing unit 48 that permanently affixes the printed data (or image) onto the sheet, and a sheet ejecting (or discharge) unit 50 that discharges the printed sheets to an output tray 52. The printing system also includes the printing apparatus 10 described above which receives sheets from the sheet feed unit, feeds charged sheets to the printing station, removes the charge from the sheet and transfers the sheets to the sheet ejecting unit.

Obviously numerous additional modifications and variations of the present invention are possible in light of the above teachings. It is therefore to be understood that within the scope of the appended claims, the present invention may be practiced otherwise than as specifically described herein.

What is claimed is:

1. A printing apparatus comprising:

a printing device for printing at a printing station an image on a sheet fed along a sheet feeding path;

a pair of rollers provided at a charge applying station, each having an outer layer of elastic material having a predetermined unit resistivity, said outer layers of said pair of rollers being in pressure contact for feeding the sheet along said sheet feeding path toward said printing station, said pressure contact between said outer layers of said rollers creating a static charge on the sheet as the sheet passes between said rollers;

a sheet guide device positioned adjacent said printing station that guides the sheet through the printing station while creating an attraction force with the charged sheet to attract the sheet to said guide device; and a heater provided at the charge applying station for heating the sheet at the charge applying station.

2. The printing apparatus as claimed in claim 1, wherein said predetermined unit resistivity ranges from between about $1\times10^{10}$ Ω·cm and about $1\times10^{20}$ Ω·cm.

3. The printing apparatus as claimed in claim 1, wherein said elastic material of at least one of said pair of rollers comprises silicon rubber.

4. The printing apparatus as claimed in claim 3, wherein said silicon rubber has a unit resistivity ranging from between about $1\times10^{10}$ Ω·cm and about $1\times10^{20}$ Ω·cm.

5. The printing apparatus as claimed in claim 1, wherein said guide device comprises a plate.

6. The printing apparatus as claimed in claim 5, wherein said plate is made of a polyester resin.

7. The printing apparatus as claimed in claim 1, wherein said guide device comprises a transfer belt system positioned adjacent said printing device.

8. The printing apparatus as claimed in claim 7, wherein said transfer belt system comprises:

a belt; and a plurality of belt rollers for applying tension to said belt and rotating said belt.

9. The printing apparatus as claimed in claim 8, wherein said belt is made of a polyester resin.

10. The printing apparatus as claimed in claim 1, further comprising a pair of transfer rollers positioned along said sheet feeding path after said printing station which receive the sheet from said guide device and further feeds the sheet along said sheet feeding path.

11. The printing apparatus as claimed in claim 1, further comprising a charge dissipating device positioned along said sheet feeding path after said printing station to remove charge carried on the sheet.

12. The printing apparatus as claimed in claim 11, wherein said charge dissipating device is positioned to contact the sheet to dissipate charge carried on the sheet.

13. The printing apparatus as claimed in claim 11, wherein said charge dissipating device comprises a grounded brush that contacts the sheet.

14. The printing apparatus as claimed in claim 1, wherein said heater heats the sheet to remove moisture from the sheet.

15. The printing apparatus as claimed in claim 14, wherein said heater comprises:

a heating element positioned in at least one of said pair of rollers; and a heat conducting layer positioned between said outer layer of said at least one of said pair of rollers and said heating element.

16. The printing apparatus as claimed in claim 15, wherein said heating element is a bar heater.

17. A printing apparatus comprising:

printing means for printing at a printing station an image on a sheet fed along a sheet feeding path;

sheet feeding means for feeding the sheet along at least a portion of said sheet feeding path and for applying a charge on the sheet prior to said printing station;

sheet guiding means positioned adjacent said printing station for guiding the charged sheet through said printing station while attracting the charged sheet toward said sheet guiding means; and sheet heating means for heating the sheet while applying said charge to the sheet.

18. The printing apparatus as claimed in claim 17, wherein said sheet feeding means comprises a pair of rollers each having an outer layer of elastic material with a predetermined unit resistivity, said outer layers of said pair of rollers being in pressure contact to feed sheets along said sheet feeding path toward said printing station, and to create a static charge on the sheet as the sheet passes between said pair of rollers.

19. The printing apparatus as claimed in claim 18, wherein said predetermined unit resistivity ranges from between about $1\times10^{10}$ Ω·cm and about $1\times10^{20}$ Ω·cm.

20. The printing apparatus as claimed in claim 18, wherein said elastic material of at least one of said pair of rollers comprises silicon rubber.

21. The printing apparatus as claimed in claim 20, wherein said silicon rubber has a unit resistivity ranging from between about $1\times10^{10}$ Ω·cm and about $1\times10^{20}$ Ω·cm.

22. The printing apparatus as claimed in claim 17, wherein said sheet guide means comprises a plate.

23. The printing apparatus as claimed in claim 22, wherein said plate is made of a polyester resin.

24. The printing apparatus as claimed in claim 17, wherein said sheet guide means comprises a transfer belt system positioned adjacent said printing means.

25. The printing apparatus as claimed in claim 24, wherein said transfer belt system comprises:

a belt; and a plurality of belt rollers used to apply tension to said belt and to rotate said belt through said printing station.

26. The printing apparatus as claimed in claim 25, wherein said belt is made of a polyester resin.

27. The printing apparatus as claimed in claim 17, further comprising second sheet feeding means for feeding the sheet along said sheet feeding path after the sheet passes through said printing station.

28. The printing apparatus as claimed in claim 27, wherein said second sheet feeding means comprises a pair of transfer rollers positioned along said sheet feeding path after said printing station which receive the sheet from said sheet guiding means and further feeds the sheet along said sheet feeding path.

29. The printing apparatus as claimed in claim 17, further comprising charge dissipating means positioned along said sheet feeding path after said printing station for dissipating said charge on the sheet.

30. The printing apparatus as claimed in claim 29, wherein said charge dissipating means comprises a grounded brush that contacts the sheet.

31. The printing apparatus as claimed in claim 17, wherein said sheet heating means heats the sheet to remove moisture from the sheet.

32. The printing apparatus as claimed in claim 31, wherein said sheet feeding means comprises a pair of rollers each having an outer layer of elastic material with a predetermined unit resistivity, said outer layers of said pair of rollers being in pressure contact to feed sheets along said sheet feeding path toward said printing station, and to create a static charge on the sheet as the sheet passes between said pair of rollers, and wherein said sheet heating means comprises a heating element positioned in at least one of said pair of rollers.

33. The printing apparatus as claimed in claim 32, wherein said heating element is a bar heater positioned within said at least one of said pair of rollers.

34. A system for printing on a sheet comprising:

a processing unit;

a data input unit coupled to said processing unit that receives data to be printed;

a printing apparatus coupled to said processing unit that prints the data, said printing apparatus having a printing unit for printing at a printing station the data on a sheet fed along a sheet feeding path, a sheet feeding system that feeds the sheet along at least a portion of said sheet feeding path and that applies a charge on the sheet at a charge applying station prior to said printing station, and a sheet guide positioned adjacent said printing station for guiding the charged sheet through said printing station while attracting the charged sheet toward said sheet guide;

a fixing unit coupled to said processor for fixing the data on the sheet after printing; and a sheet heating unit for heating the sheet at the charge applying station.

35. A method for feeding a sheet through a printing station where a printing device prints an image on the sheet, said method comprising:

feeding the sheet through said printing station, applying a charge on the sheet and heating the sheet while applying the charge on the sheet;

guiding the sheet on a guide through said printing station, wherein an attraction force between the charged sheet and said guide attracts the sheet to the guide;

printing on the sheet with said printing device as the sheet is guided through said printing station; and removing the sheet from said printing station.

36. The method as claimed in claim 35, further comprising separating the sheet from said guide after the sheet is removed from the said printing station.

37. The method as claimed in claim 36, further comprising removing said charge carried on the sheet after said sheet is separated from said guide.

38. A method for printing an image on a sheet as the sheet passes through a printing station, comprising:

transferring a sheet along a sheet feeding path toward a guiding device positioned adjacent the printing station and applying a charge on the sheet, wherein an attraction force between said charged sheet and said guiding device attracts said sheet toward said guiding device, and heating the sheet while applying the charge on the sheet;

transferring said charged sheet through the printing station; and printing an image on said charged sheet as said sheet passes through said printing station while said sheet is attracted to said guiding device.

39. The method as claimed in claim 38, further comprising removing said charge on said sheet after said sheet passes through said printing station.

* * * * *